US005283998A

United States Patent [19]

Jong

[11] Patent Number: 5,283,998

[45] Date of Patent: Feb. 8, 1994

[54] ROOFING TILE

[76] Inventor: Slosson B. Jong, 20722 Hunter La., Huntington Beach, Calif. 92646

[21] Appl. No.: 772,457

[22] Filed: Oct. 7, 1991

Related U.S. Application Data

[63] Continuation-in-part of Ser. No. 327,795, Mar. 23, 1989, Pat. No. 5,060,445.

[51] Int. Cl.[5] ..... E04C 1/00

[52] U.S. Cl. ..... 52/515; 52/518; 52/315; 52/454; 428/49; 428/344; 428/354; 428/355; 428/921

[58] Field of Search ..... 52/518, 515, 454, 676, 52/315, 388; 428/49, 344, 354, 355, 921; 106/18.11, 18.15

[56] References Cited

U.S. PATENT DOCUMENTS

| | | | |
|---|---|---|---|
| 772,476 | 10/1904 | Podmore | 52/311 X |
| 1,231,687 | 7/1917 | Adams | 106/245 |
| 1,824,274 | 9/1931 | Kahn et al. | 52/454 |
| 1,867,897 | 7/1932 | Stanbrough | 52/388 |
| 1,920,931 | 8/1933 | Finley | 52/315 X |
| 2,128,392 | 8/1938 | Albion | 106/18.11 X |
| 2,308,650 | 1/1943 | Desagnat | 52/388 |
| 2,734,827 | 2/1956 | Hooks | 106/18.11 |
| 2,861,012 | 9/1958 | Lowell | 106/18.15 X |
| 2,887,867 | 5/1959 | Burchenal et al. | 52/388 |
| 3,224,890 | 12/1965 | Skelton et al. | 106/18.11 |
| 3,398,019 | 8/1968 | Langguth et al. | 106/18.15 |
| 3,474,584 | 10/1969 | Lynch | 52/315 X |
| 3,502,539 | 3/1970 | MacPhail | 52/315 |
| 3,630,764 | 12/1971 | Shannon | 106/15 |
| 3,885,075 | 5/1975 | Ferrante | 52/309.5 X |
| 4,031,285 | 6/1977 | Miller et al. | 428/294 |
| 4,525,970 | 7/1985 | Evans | 52/454 |
| 4,655,837 | 4/1987 | Jong . | |
| 4,714,507 | 12/1987 | Ohgushi | 156/91 |
| 4,739,603 | 4/1988 | Butler | 52/750 |
| 4,745,032 | 5/1988 | Morrison | 52/309.1 X |
| 4,765,113 | 8/1988 | Jong . | |
| 4,793,892 | 12/1988 | Miller et al. | 156/549 |
| 5,030,502 | 7/1991 | Teare | 428/143 |
| 5,060,445 | 10/1991 | Jong | 52/553 |
| 5,102,726 | 4/1992 | Gabbay | 428/251 |
| 5,151,127 | 9/1992 | Thompson | 106/18.15 X |

*Primary Examiner*—Carl D. Friedman
*Assistant Examiner*—Robert Canfield
*Attorney, Agent, or Firm*—William P. Green

[57] ABSTRACT

A roofing tile including a tile body having an upper surface covered with a fire resistant coating including an acrylic or asphaltic adhesive, usually the former, containing a wire mesh and intermixed with fire retardant particles formed of a material or materials selected from the group consisting of sodium carbonate, ammonium phosphate and a light weight portland cement concrete, with decorative and heat resistant particles adhered to the upper surface of the adhesive, and desirably including a top layer of sodium silicate covering the last mentioned particles.

18 Claims, 3 Drawing Sheets

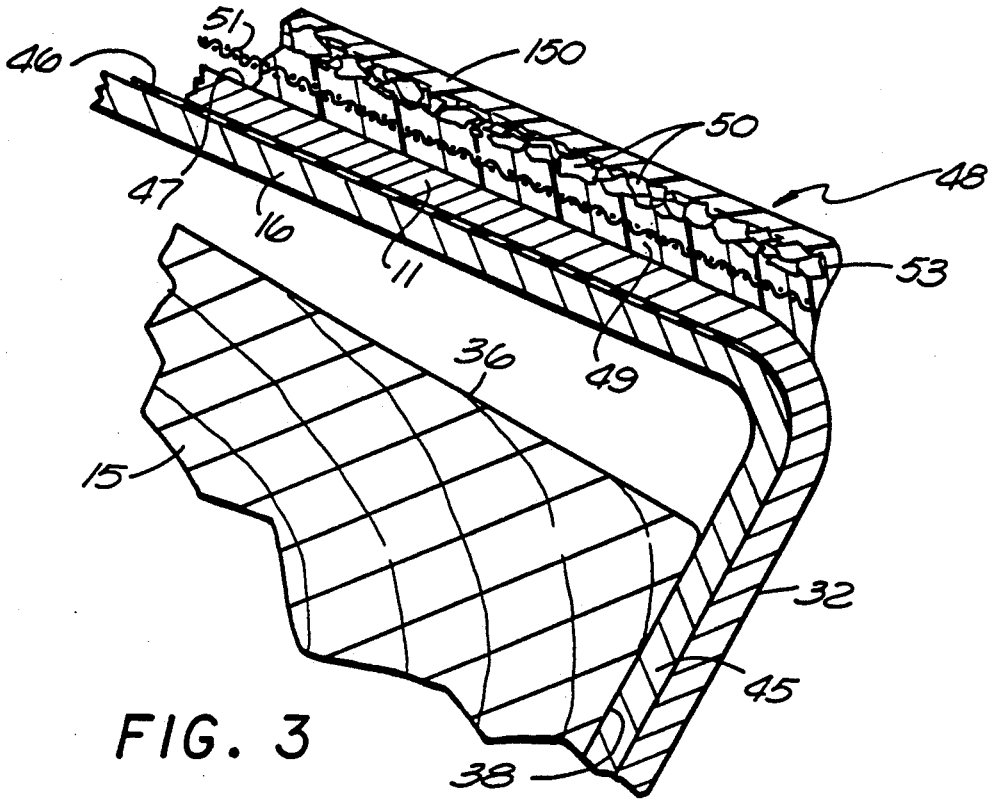
FIG. 3
FIG. 4
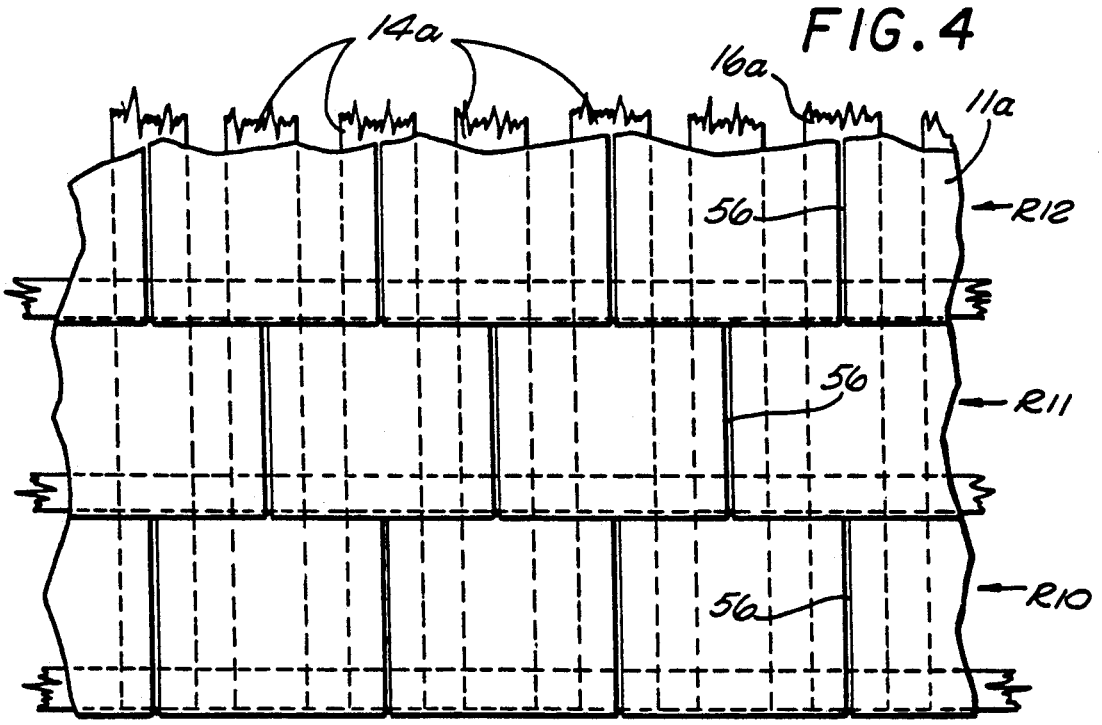

ROOFING TILE

This application is a continuation-in-part of copending application Ser. No. 7/327,795 entitled "Roof Construction" and filed Mar. 23, 1989, now U.S. Pat. No. 5,060,445.

BACKGROUND OF THE INVENTION

This invention relates to improved fire resistant tiles for use in roof structures or the like.

In recent years, building codes in many areas have become increasingly more rigid in requiring that roofs of homes or other buildings be resistant to fire. One way of satisfying this requirement is by treating wooden shingles or shakes with a chemical, such as sodium silicate, intended to be fire resistant. Another approach is to utilize shingles or tiles formed of a material other than wood and which is fire resistant. In some instances, tiles stamped from sheet metal are utilized. However, such metal tiles may tend to conduct heat too readily between the interior and exterior of a building and therefore adversely affect the insulation characteristics of the building.

SUMMARY OF THE INVENTION

A major purpose of the present invention is to provide a roofing tile which can be essentially permanent, highly fire resistant, heat insulative and watertight, and which achieves all of these purposes at minimum cost. The tile is preferably formed of metal, but may if desired be formed of other materials such as wood, and is covered on its upper surface with decorative and fire and heat resistant material.

Certain features of novelty of the invention relate to the coating materials which are employed to give the tile its decorative and fire and heat resistant characteristics. In accordance with the invention, the upper surface of the tile has a coating of acrylic or asphaltic adhesive material adhered thereto, with one or more fire resistant substances intermixed with the adhesive and including at least one substance selected from the group consisting of sodium carbonate, ammonium phosphate and portland cement, preferably all three. The portland cement is desirably present as a constituent of a light weight concrete of the type disclosed and claimed in my U.S. Pat. No. 4,655,837, the disclosure of which is incorporated in the present application by reference.

The adhesive coating may be reinforced by mesh embedded therein. The upper surface of the adhesive coating is preferably covered with decorative and fire resistant particles, which may be coated with a layer of sodium silicate.

BRIEF DESCRIPTION OF THE DRAWINGS

The above and other features and objects of the invention will be better understood from the following detailed description of the typical embodiments illustrated in the accompanying drawings in which:

FIG. 3 is an enlarged detail view corresponding to a portion of FIG. 2; and

FIG. 4 is a reduced fragmentary elevational view similar to FIG. 1, but showing a variational arrangement in which the tiles of successive rows are staggered with respect to one another.

DESCRIPTION OF THE PREFERRED EMBODIMENTS

Figure 1:
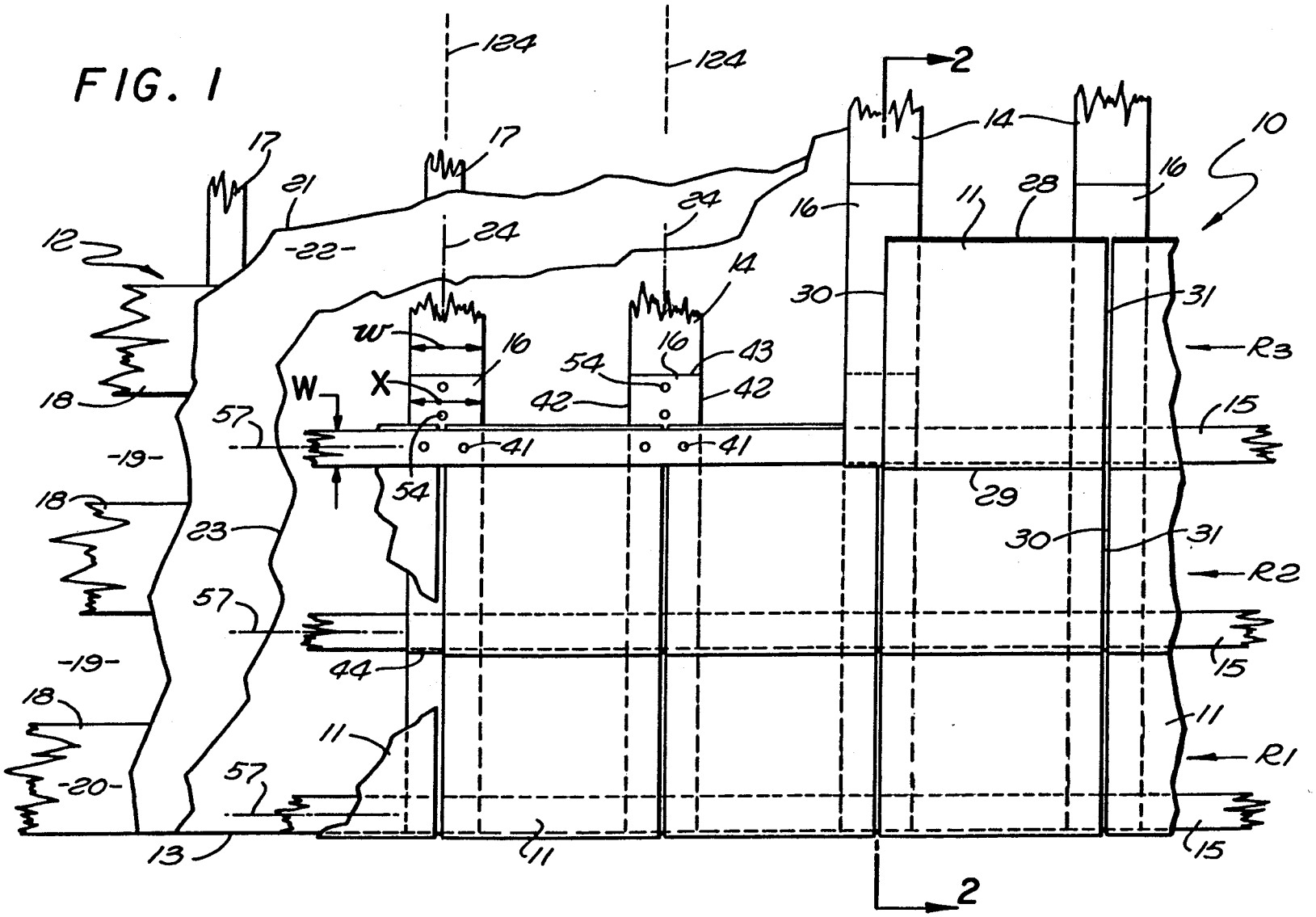
FIG. 1 is a fragmentary top elevational view of a roof utilizing a tile embodying the invention.
Figure 2:
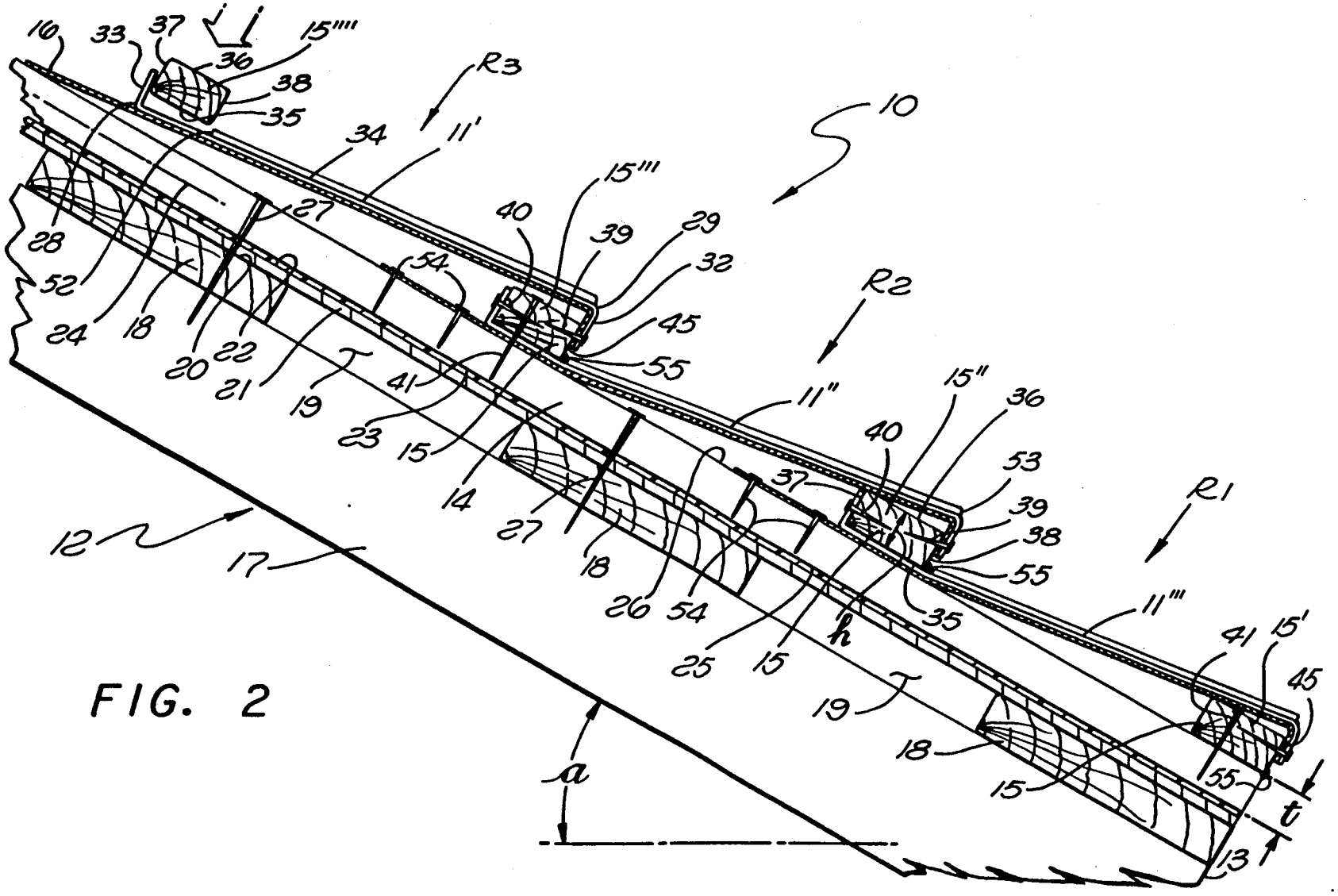
FIG. 2 is an enlarged fragmentary vertical section taken on line 2—2 of FIG. 1.

The roof 10 illustrated in FIGS. 1 and 2 includes a number of identical sheet metal tiles 11 attached to an inclined roof substructure 12 and arranged on that substructure in horizontally extending rows R1, R2, R3, etc., up to the number of rows required to completely cover the substructure from its lower eave edge 13 to the peak of the roof. The tiles may be retained on the substructure by a series of parallel inclined boards 14 extending upwardly and downwardly at an inclination along the upper surface of the substructure, and by a series of horizontally extending parallel boards 15 acting as tie-down elements for securing the tiles to boards 14. The tiles are strengthened and sealed along their side edges by metal supporting straps 16.

As seen in FIG. 2, the substructure 12 of the roof may include conventional rafters 17 extending parallel to one another from the lower edge of the roof to its upper edge and inclined at an angle a with respect to the horizontal. Attached to the upper sides of the rafters are a series of conventional purlins or sheathing boards 18, elongated horizontally and extending parallel to one another and typically of nominal one inch by six inch cross-section. In the usual roof substructure, these boards 18 are spaced apart to leave elongated gaps 19 between the boards. The upper surfaces 20 of sheathing boards 18 lie in a common plane disposed at the inclination angle a with respect to the horizontal.

The substructure of the roof preferably includes also a thin layer 21 of plywood or other similar sheet material, nailed or otherwise secured to the upper surfaces 20 of boards 18 and extending across the entire area of the roof. This plywood may typically be one-fourth inch or three-eighths of an inch in thickness, and presents an upper inclined surface 22 which is planar and disposed at the inclination of angle a. Extending along the upper surface of the plywood layer 21, the roof assembly includes a sheet or sheets 23 of asphalt impregnated paper, which are nailed to the plywood and to boards 18, and which may be sealed at the locations of the nails and along the edges of overlapping sheets of the tar paper, to provide a continuous waterproof layer covering the entire area of the roof and positively preventing leakage of any water downwardly through that layer. The plywood sheets 21 and boards 14 and 15 are preferably all pretreated with an insect and fire resistance chemical, desirably sodium pentachlorophene.

After the plywood and the asphalt sheets 23 have been nailed in place, the boards 14 are next attached to the roof. These boards are elongated and extend along parallel axes 24 inclined at the same slope angle a as the other portions of the roof to extend parallel to the upper surface of plywood layer 21 and to asphalt sheets 23. It will also be apparent that the longitudinal axes 24 of boards 14 are perpendicular to the lower edge 13 of the roof and to the peak of the roof (not shown), and lie in spaced parallel vertical planes represented at 124 in FIG. 1. Boards 14 have planar undersurfaces 25 engaging the asphalt paper, and have planar upper surfaces 26 lying in a common plane and disposed at the slope angle of the roof. The crosssection of each board 14 transversely of its longitudinal axis 24 may typically be nominally one inch by four inches, with the smaller of those dimensions being the thickness dimension t represented in FIG. 2, and with the greater dimension being the width w as seen in FIG. 1. Boards 14 are secured to boards 18 by nails represented at 27 in FIG. 2.

Each of the tiles 11 is preferably cut and stamped from sheet metal, desirably twenty six gauge steel, and may be square in outline configuration as viewed in FIG. 1. More particularly, each tile may have a higher or top edge 28, a lower or bottom edge 29, and two opposite side edges 30 and 31. Edges 28 and 29 are parallel to one another and extend horizontally in the assembled condition of the roof, while side edges 30 and 31 are perpendicular to edges 28 and 29 and parallel to one another and extend upwardly along the roof at an inclination. The left edge 30 of each of the tiles is received closely adjacent and extends parallel to the right edge 31 of the next successive tile in the same row.

With regard now to FIG. 2, each of the tiles 11 initially has the vertical sectional configuration of the tile shown at 11' in FIG. 2. After the tile has been nailed to the roof, it assumes the slightly changed configuration of the tiles 11" and 11"' in FIG. 2. To describe the initial shape 11' in greater detail, the sheet metal of the tile in that condition is shaped to form a flange 32 along the lower edge portion 29 of the tile, and a second flange 33 along the upper edge 28 of the tile. The portion 34 of the tile between flanges 32 and 33 is initially completely flat and planar over its entire area between the various edges of the tile. Flange 32 extends essentially perpendicular to portion 34 of the tile, and projects downwardly toward the substructure and essentially perpendicular to the plane of upper surfaces 26 of boards 14. The second flange 33 at the upper edge of the tile is also essentially perpendicular to the main portion 34 of the tile but projects upwardly away from the substructure essentially perpendicular to surfaces 26 of boards 14. It will also be understood that each of the flanges 32 and 33 is itself essentially planar across its entire area, and is disposed essentially perpendicular to the axes 24 and vertical planes 124.

The bottom edge flange 32 of each tile overlaps or extends beyond the upper edge flange 33 of the next lower tile, with a corresponding one of the horizontal tie-down boards 15 received between the flanges in an interfitting relation (FIG. 2) and secured to the flanges to rigidly retain the tiles in their illustrated positions. Boards 15 are elongated horizontally along parallel axes 57 which are perpendicular to axes 24 of boards 14 and to the vertical planes 124. Boards 15 are of uniform cross-section transversely of their length, with that cross-section preferably being nominally one inch by two inches. The shorter of these dimensions is the height h perpendicular to upper surfaces 26 of boards 14, and the larger of the two transverse dimensions of boards 15 is the width W. As seen in FIG. 2, the planar undersurfaces 35 and upper surfaces 36 of boards 15 are parallel to one another and inclined to be parallel to upper surfaces 26 of boards 14. Planar edge surfaces 37 and 38 of boards 15 are parallel to one another and perpendicular to surfaces 35, 36 and 26. In the assembled roof, flange 33 of one of the tiles is received adjacent and parallel to surface 37 of one of the boards 15, and is secured thereto by nails 40 driven through flange 33 and into the board 15. The flange 32 of a next upper tile 11 is parallel to and received adjacent the surface 38 of the same board 15, and is secured thereto by nails 39 driven through the flange and into the board. Boards 15 are attached rigidly to the substructure by nails 41 driven downwardly through boards 15 and through the metal of the tiles and into boards 14. As each board is thus secured in place, the driving of the nails acts to bend the underlying portion of each of the tiles 11 from the condition of the tile 11' in FIG. 2 to the condition of the tiles 11" and 11"' in that figure. As will be noted, each of the tiles 11" and 11"' has been bent slightly at the lower edge of a corresponding member 15 so that the portion of the sheet metal tiles vertically between each board 15 and the corresponding board 14 is directly parallel to and clamped between surfaces 26 and 35.

The strengthening and sealing straps 16 are stamped of sheet metal, preferably of the same twenty six gauge steel as tiles 11. Each of the straps 16 overlies one of the boards 41 and may have a width x corresponding to the width w of boards 14. Each strap may be considered as defined by two parallel opposite side edges 42, a transverse upper edge 43, and a lower edge 44. At that lower edge, the sheet material of strap 16 may be turned downwardly toward surface 26 to form a flange 45 projecting toward surface 26 of the corresponding board 14 in the assembled condition of the elements. This flange 45 is parallel to flange 32 at the lower edge of one of the tiles, and after assembly is received between that flange and surface 38 of one of the boards 15. The nails 39 are driven through both of the flanges and into board 15 to secure the flanges tightly to the board. Except at the location of downturned flange 45, each metal strap 16 is initially flat from that flange to its upper edge 43 (see upper end of FIG. 2). When the nails 41 are driven downwardly through one of the boards 15 and a corresponding tile 11, those nails are also driven through the underlying portion of one of the straps 16, to bend the strap into parallelism with surfaces 26 and 35 in correspondence with the previously discussed bending of the upper edge portion of the tile. Thus, the straps 16 are deformed to their ultimate shape and locked in position by the same boards 15 which hold the tiles in place. As will be apparent from FIG. 1, each of the straps 16 projects laterally beneath an edge portion of each of two adjacent tiles near their side edges 30 and 31, to add the strength of the strap to that of the tiles in assuring effective and permanent support of the tiles at their edges. Also, the straps 16 in extending across the gaps between adjacent side edges 30 and 31 of the tiles form closures preventing the flow of water downwardly through those gaps. To enhance this water sealing action, the upper surfaces of the straps 16 are preferably coated with a sealant such as asphalt for contacting the undersurfaces of the tiles and forming a continuous watertight seal between the strap and each of the tiles along the entire length of each of the side edges 30 and 31 of the tiles. This asphalt seal between straps 16 and the tiles is represented at 46 in FIG. 3.

For appearance and improved fire resisting characteristics, the upper surfaces 47 of the metal tiles are coated with a layer 48 of material adhered tightly to the tiles and having decorative, heat insulative and fire retardant qualities. This layer 48 desirably includes a coating 49 of an adhesive substance with particles 50 of sand, glass 'smaltz', rock or other materials of low heat conductivity distributed across and adhered to the upper surface of the adhesive and covered with a layer 150 of sodium silicate. There is desirably embedded within the adhesive 49 a layer of preferably metal mesh 51, extending across the entire area of the layer 48 and tightly bonded thereto by curing of the adhesive material. This layer of mesh may be formed of expanded metal or woven wire mesh or the like, and acts to resist breakage or cracking of the layer 48 in handling of the tile or under forces encountered after the roof is completed. As seen in FIG. 2, the decorative and heat insulative layer 48 terminates upwardly at an edge 52 which is received closely adjacent board 15 in the assembled condition of the roof, and terminates downwardly at an edge 53 just short of the downturned flange 32 so that the layer 48 does not cover the flange.

Coating 49 includes an adhesive or adhesives selected from the group consisting of acrylic adhesives and asphalt, preferably the former when the tiles are formed of metal. One or more fire resistant substances are intermixed intimately with and distributed throughout the adhesive of coating 49. These substances desirably include materials selected from the group consisting of sodium carbonate, ammonium phosphate and portland cement, desirably all three being present. Alternatively the coating 49 may in some instances include portland cement in combination with either sodium carbonate or ammonium phosphate, or only one of the three materials may if desired be employed. Each of the materials is preferably utilized in finely divided form to provide a large number of particles of each selected substance distributed throughout and adhered to the adhesive material.

If portland cement is one of the substances mixed with the adhesive of coating 49, or is the only one of the three substances therein, the portland cement is preferably present as a constituent of a light weight, fire resistant concrete of essentially the composition disclosed and claimed in my U.S. Pat. No. 4,655,837 issued Apr. 7, 1987 on "Building Material and Manufacture Thereof". The details of the process disclosed in my prior application for preparation of the concrete are incorcorporated herein by reference. The preferred composition for forming the concrete includes, and desirably consists essentially of, the following ingredients in about the proportions set forth below, by weight, intermixed with water in an amount rendering the composition moldable:

| | |
|---|---|
| portland cement | 70 to 94 parts |
| gypsum | 10 to 30 parts |
| sodium hydroxide | 1 to 3 parts |
| sodium silicate solution (saturated) | 150 to 275 parts |
| particles of a metal or metals selected from the group consisting of aluminum and zinc | 1/4 to 1 1/2 parts |
| an acidic ingredient (preferably sodium thiosulfate) | 2 to 5 parts |

The concrete composition may additionally in some instances include up to about 50% by weight (preferably between 25% and 50%) of wood particles impregnated with sodium pentachlorophenol and/or carbon tetrachloride in accordance with the teachings of my U.S. Pat. No. 4,765,113. The disclosure of that prior patent is therefore also incorporated herein by reference.

The ingredients of the concrete composition may first be intermixed intimately together to form a modable composition, and then be placed in an appropriate mold and allowed to dry and harden, preferably for a period of several days (say four days) to a hardened porous condition. After the light weight concrete has cured to a hardened condition, it can be crushed to a fine particulate form, and then be intermixed with the acrylic or asphaltic adhesive of coating 49, and with the sodium carbonate and/or ammonium phosphate. The adhesive composition with contained additives is then coated on the tile, particles 50 are applied thereto, and the adhesive is cured or hardened in place to a condition in which it adheres tightly to the tile body and particles 50, mesh 51 and the fire resistive materials contained in the adhesive. After hardening of the adhesive, the final coating of sodium silicate is applied to the composite tile.

In the composition as applied to the tile body before hardening, and in the final hardened coating 49 (not including mesh 51, particles 50 and sodium silicate layer 150), the ingredients are preferably present in about the following proportions by weight:

| | |
|---|---|
| acrylic or asphaltic adhesive | 1 to 2 parts |
| sodium carbonate and/or ammonium phosphate | 2 to 1 parts |
| light weight concrete particles | 2 to 1 parts |

If both sodium carbonate and ammonium phosphate are present in the above composition, the ingredients are preferably utilized in the following proportions:

| | |
|---|---|
| acrylic or asphaltic adhesive | 1 to 2 parts |
| sodium carbonate | 2 to 1 parts |
| ammonium phosphate | 2 to 1 parts |
| light weight concrete particles | 2 to 1 parts |

To now describe the process which is followed in assembling the roof of FIGS. 1 and 2 on the roof substructure, assume that plywood layer 21 and the asphalt paper 23 have been attached to boards 18. The next step is to nail the base boards 14 in place on top of the asphalt paper and parallel to one another, with these boards extending upwardly along the inclined roof from its lower edge to its upper edge. The person installing the roof then attaches a first of the transverse tie-down boards 15 to the lower edge of the roof at the position of the particular board identified by the number 15' in FIG. 2. Next, the tiles 11''' of the first row R1 and the straps 16 underlying the edges of those tiles are moved into position, and the lower flanges 32 and 45 of those tiles and straps are secured to the first horizontal board 15' by nails driven through the flanges and into the board. The upper ends of the straps 16 are nailed to boards 14 at 54. Seals may be formed between board 15' and the boards 14 by application of mastic at 55 between these boards along the entire width of each of the boards 14.

Along the upper edges of the first row R1 of tiles, the second of the horizontal tie-down members (15'' in FIG. 2) is moved into position adjacent the upwardly turned upper flanges 33 of the tiles, and that board 15'' is secured in place by driving nails 41 downwardly through the board and through the tiles and straps 16 into boards 14. Also, flanges 33 are at this point secured to board 15'' by nails 40. Thereafter, the tiles 11'' of the next row R2 of tiles, and the corresponding underlying straps 16 of that row, are moved into position as seen in FIG. 2, with the lower flanges 32 and 45 of these tiles and straps being nailed to tie down strip 15'', and with the upper ends of the straps 16 being nailed to boards 14. The third of the boards 15 (identified as 15''' in FIG. 2)

is then nailed in place, and the flanges of the tiles R2 and R3 are secured thereto by nails extending through the flanges and into the board, after which the next successive horizontal tie-down board 15'''' is moved into place and the process is repeated as many times as necessary to complete the entire roof. At the lower edge of each of the boards 15, mastic 55 is applied in correspondence with the discussion of the application of such mastic to the lowermost of these boards. As each of the straps 16 is moved into place, its upper surface may be coated with tar, asphalt or another sealant as represented at 46 in FIG. 3, to form the discussed seals against leakage of water along the side edges of the tiles.

FIG. 4 illustrates an arrangement which may be identical with that of FIGS. 1 and 2 except that the tiles 11*a* of successive horizontal rows of tiles are staggered horizontally relative to one another. For example, the tiles 11*a* of the first row R10 of FIG. 4 may be located in positions corresponding exactly to the positions of the tiles of row R1 of FIG. 1. However, the tiles of the next successive row R11 of FIG. 4 are offset horizontally so that the side edges 56 of the tiles of row R11 are located midway between the side edges 56 of the tiles of row R10. The tiles of the next successive row R12 have their edges 56 aligned with the edges of the first row R10. This pattern is continued through the entire area of the roof. In order to accomodate this staggered pattern, there must be twice as many boards 14*a* in the FIG. 4 arrangement as in the FIG. 1 arrangement, to allow attachment of all of the tiles and the associated straps 16*a* to the members 14*a*.

It is contemplated that if desired a roof of the described type may be applied over an old roof already in place on the building. This can reduce the overall cost considerably in view of the very substantial cost which is involved in removing an old roof. The plywood sheets may be placed directly on top of the old roof and nailed thereto, after which the asphalt paper and other components shown in the drawings are attached to the plywood as discussed.

While certain specific embodiments of the present invention have been disclosed as typical, the invention is of course not limited to these particular forms, but rather is applicable broadly to all such variations as fall within the scope of the appended claims.

I claim:

1. A tile for covering a building comprising:

a tile body having an upper surface;

a coating adhered to said upper surface and including acrylic adhesive, at least one fire retardant substance intermixed with said adhesive and selected from the group consisting of sodium carbonate and ammonium phosphate, and light weight concrete particles intermixed with said adhesive and with said at least one fire retardant substance and formed from a composition consisting essentially of the following ingredients in the proportions set forth below, by weight,

| | |
|---|---|
| portland cement | 70 to 94 parts |
| gypsum | 10 to 30 parts |
| sodium hydroxide | 1 to 3 parts |
| sodium silicate solution (saturated) | 150 to 275 parts |
| particles of a metal or metals selected from the group consisting of aluminum and zinc | ¼ 1½ parts |
| an acidic ingredient | 2 to 5 parts; and |

-continued

| | |
|---|---|
| water in an amount rendering the concrete composition moldable; and | |

decorative particles adhered to said coating.

2. A tile as recited in claim 1, including a mesh embedded within and reinforcing said coating.

3. A tile as recited in claim 1, including a layer of sodium silicate adhered to and covering said decorative particles.

4. A tile as recited in claim 1, including both sodium carbonate and ammonium phosphate.

5. A tile as recited in claim 1, in which the ingredients of said coating are present in about the following proportions, by weight:

| | |
|---|---|
| acrylic adhesive | 1 to 2 parts |
| fire retardant substance [or substances] | 2 to 1 parts |
| light weight concrete particles. | 2 to 1 parts |

6. A tile as recited in claim 5, including a mesh embedded within and reinforcing said coating.

7. A tile as recited in claim 6, including a layer of sodium silicate adhered to and covering said decorative particles.

8. A tile as recited in claim 1, in which the ingredients of said coating are present in about the following proportions, by weight:

| | |
|---|---|
| acrylic adhesive | 1 to 2 parts |
| sodium carbonate | 2 to 1 parts |
| ammonium phosphate | 2 to 1 parts |
| light weight concrete particles. | 2 to 1 parts |

9. A tile as recited in claim 8, including a metal mesh embedded within said coating and a layer of sodium silicate covering said decorative particles.

10. A tile as recited in claim 1, in which said particles are selected from the group consisting of sand, glass and rock.

11. A tile for covering a building, comprising:

a tile body having an upper surface;

a coating adhered to said upper surface and including adhesive selected from the group consisting of acrylic and asphaltic adhesives, with portland cement distributed throughout said adhesive; and decorative particles adhered to said coating.

12. A tile as recited in claim 11, including a layer of sodium silicate adhered to and covering said decorative particles.

13. A tile as recited in claim 11, in which said portland cement is present in the form of concrete particles intermixed with the adhesive.

14. A tile as recited in claim 11, in which said portland cement is present in the form of light weight concrete particles intermixed with the adhesive and formed from a composition consisting essentially of the following ingredients in the proportions set forth below, by weight:

| | |
|---|---|
| portland cement | 70 to 94 parts |
| gypsum | 10 to 30 parts |
| sodium hydroxide | 1 to 3 parts |

-continued

| | |
|---|---|
| sodium silicate solution (saturated) | 150 to 275 parts |
| particles of a metal or metals selected from the group consisting of aluminum and zinc | 1/4 to 1 1/2 parts |
| an acidic ingredient | 2 to 5 parts |
| water in an amount rendering the concrete composition moldable. | |

15. A tile as recited in claim 11, including at least one fire retardant substance intermixed with said adhesive and selected from the group consisting of sodium carbonate and ammonium phosphate.

16. A tile as recited in claim 11, including a mesh embedded within and reinforcing said coating.

17. A tile as recited in claim 11, in which said portland cement is present in the form of light weight concrete particles intermixed with the adhesive and formed from a composition consisting essentially of the following ingredients in the proportions set forth below, by weight:

| | |
|---|---|
| portland cement | 70 to 94 parts |
| gypsum | 10 to 30 parts |
| sodium hydroxide | 1 to 3 parts |
| sodium silicate solution (saturated) | 150 to 275 parts |
| particles of a metal or metals selected from the group consisting of aluminum and zinc | 1/4 to 1 1/2 parts |
| an acidic ingredient | 2 to 5 parts |
| wood particles impregnated with a substance selected from the group consisting of sodium pentachlorophenol and carbon tetrachloride | |

-continued

| | |
|---|---|
| water in an amount rendering the concrete composition moldable. | |

18. A tile for covering a building, comprising:

a tile body having an upper surface;

a coating adhered to said upper surface and including adhesive selected from the group consisting of acrylic and asphaltic adhesives, with portland cement distributed throughout said adhesive;

said portland cement being present in the form of light weight concrete particles intermixed with the adhesive and formed from a composition consisting essentially of the following ingredients int he proportions set forth below, by weight:

| | |
|---|---|
| portland cement | 70 to 94 parts |
| gypsum | 10 to 30 parts |
| sodium hydroxide | 1 to 3 parts |
| sodium silicate solution (saturated) | 150 to 275 parts |
| particles of a metal or metals selected from the group consisting of aluminum and zinc | 1/4 to 1 1/2 parts |
| an acidic ingredient | 2 to 5 parts |
| water in an amount rendering the concrete composition moldable; | |

decorative particles adhered to said coating;

a mesh embedded within and reinforcing said coating;

a layer of sodium silicate adhered to and covering said decorative particles; and a fire retardant substance intermixed with said adhesive and selected from the group consisting of sodium carbonate and ammonium phosphate.

* * * * *